US006698062B2

(12) United States Patent
Egger et al.

(10) Patent No.: US 6,698,062 B2
(45) Date of Patent: Mar. 2, 2004

(54) HINGE WITH HEIGHT ADJUSTMENT SCREW

(75) Inventors: Remo Egger, Bregenz (AT); Wolfgang Mueller, Lustenau (AT)

(73) Assignee: Grass GmbH, Voralberg (AT)

( * ) Notice: Subject to any disclaimer, the term of this patent is extended or adjusted under 35 U.S.C. 154(b) by 0 days.

(21) Appl. No.: 10/086,480

(22) Filed: Mar. 1, 2002

(65) Prior Publication Data

US 2002/0166207 A1 Nov. 14, 2002

(51) Int. Cl.[7] ..... E05D 7/04; E05D 7/06
(52) U.S. Cl. ..... 16/242; 16/382
(58) Field of Search ..... 16/242, 246, 245, 16/236, 272, 382; 312/401, 405

(56) References Cited

U.S. PATENT DOCUMENTS

| | | | | |
|---|---|---|---|---|
| 4,506,409 A | * | 3/1985 | Lautenschlager | 15/238 |
| 4,558,485 A | | 12/1985 | Rock et al. | |
| 4,590,641 A | | 5/1986 | Lautenschlager et al. | |
| 4,654,932 A | | 4/1987 | Rock et al. | |
| 4,691,408 A | | 9/1987 | Rock et al. | |
| 4,976,006 A | | 12/1990 | Lautenschlager | |
| 5,022,116 A | | 6/1991 | Salice | |
| 5,025,530 A | | 6/1991 | Ferrari et al. | |
| 5,036,565 A | | 8/1991 | Salice | |
| 5,056,189 A | | 10/1991 | Brustle et al. | |
| 5,062,180 A | | 11/1991 | Lautenschlager | |
| 5,210,907 A | | 5/1993 | Toyama | |
| 5,245,727 A | | 9/1993 | Sasaki | |
| 5,257,437 A | | 11/1993 | Salice | |
| 5,412,840 A | | 5/1995 | Lautenschlager et al. | |
| 5,511,287 A | | 4/1996 | Lautenschlager et al. | |
| 5,577,297 A | | 11/1996 | Lautenschlager et al. | |
| 5,737,804 A | * | 4/1998 | Ferrari et al. | 16/242 |
| 6,049,946 A | * | 4/2000 | Cress et al. | 16/240 |
| 6,061,872 A | | 5/2000 | Albrecht et al. | |
| 6,145,164 A | * | 11/2000 | Ferrari et al. | 16/242 |
| 6,339,864 B1 | | 1/2002 | Albrecht et al. | |
| 6,438,798 B1 | * | 8/2002 | Chene et al. | 16/335 |
| 6,615,452 B2 | * | 9/2003 | Mueller et al. | 16/242 |

FOREIGN PATENT DOCUMENTS

| | | |
|---|---|---|
| DE | 298 11 793 | 12/1999 |
| DE | 299 14 473 | 2/2000 |
| EP | 0 969 173 | 1/2000 |

* cited by examiner

*Primary Examiner*—Anthony Knight
*Assistant Examiner*—André L. Jackson
(74) *Attorney, Agent, or Firm*—John M. Harrington; Kilpatrick Stockton LLP

(57) ABSTRACT

The invention concerns a hinge, in particular a cabinet hinge with a baseplate that fastens to the cabinet body and a baseplate with a supporting adjusting plate than can be connected to the cabinet hinge, so that a secure fastening of the catch connection is provided. In order to attain a stabile connection that, at the same time, provides an easy assembly, the baseplate is formed in two parts—one lower part that fastens to the cabinet body and an upper part that tenses into the lower part. A height adjusting screw is provided to secure and vertically adjust the upper part on the lower part and has at least one eccentric or cam disks with an angle-dependent modification of the radius and whose eccentric or cam disk work together with at least one corresponding gliding cam of the upper part. The advantage, here, is that no self-activated adjustment of the hinge is possible, because the cam disks of the clamping height adjusting screw; both assembly components of the baseplate's upper and lower parts clamp together, are self-locking. This height adjustment is easy and simple to achieve smoothly, even with heavy cabinet doors.

22 Claims, 4 Drawing Sheets

HINGE WITH HEIGHT ADJUSTMENT SCREW

FIELD OF THE INVENTION

The invention involves a hinge with a height adjustment screw, in particular for the cabinet/furniture hinge, according to the principal concept of Patent claim 1.

BACKGROUND OF THE INVENTION

A mounting plate of this type is made known by DE 19920 137 A1. The invention at hand makes full reference to this document because all features and characteristics shown and indicated there are present here also.

In this document DE 19920 137 A1 a cabinet/furniture hinge with a hinge cup is shown that fastens to a hinge arm or a hinge, so that the hinge arm is adjustable by an adjusting plate that can be connected to the cabinet by a fastened baseplate, and a catch connection is provided to lock and secure the connection. The adjusting plate is designed in one piece with a partially springy catch component that, on the one side, can be engaged (hanged in) by means of hooked-shaped shanks on the baseplate, and, on the other side, has shanks that, by pressure on the adjusting plate, forces the sliding movement of the adjusting plate relative to the baseplate to engage in the corresponding catch nose (s) of the baseplate, so that the springy part of the adjusting plate protects the connection against further shifting or sliding.

In document DE 19920 137 A1 the baseplate is designed in two pieces, with the lower part that can be fastened to cabinet body and an upper part that can be twisted into the lower part by means of a clamping screw; whereby, the adjusting plate and the upper part are connected together at at least three engagement points by pressure on the adjusting plate due to a shifting or sliding movement of the adjusting plate relative to the baseplate, and secures the connection by means of a spring element on the adjusting plate against further shifting or movement. The height adjustment of the cabinet door takes place via the loosening of the clamping screw between the upper part and the lower part of the baseplate, sliding or shifting the upper part on the lower part and then securing the clamping screw.

The two-piece mounting plate described above has the disadvantage that when the clamping screw is loosened, the hinge connection between the upper part and the lower part of the baseplate is also loosened so that the cabinet door together with the entire hinge, except for the lower part of the baseplate on the cabinet's body, moves downward with gravitational force because of the cabinet door's own weight. Thus, a sensitive and exact adjustment of the hinge in a vertical height direction is not possible, because the height adjustment method is not guided and results by means of a supported shifting or sliding of the baseplate's upper part on the baseplate's upper part.

A multiplicity of different adjusting possibilities already exists for cabinet/furniture hinges.

So, adjustments are possible for the hinge arm's position relative to the mounting plate in the direction of the cabinet reveal, that is, a side adjustment of the cabinet door. This adjustment is achieved by the so-called side adjusting screw, that is stored in a thread of the hinge arm and is held with its head in a recess in the mounting plate. Depending upon the turn of the screw, the screw lifts the hinge arm more or less from the mounting plate, resulting in a side or lateral adjustment of the cabinet door.

Another adjustment possibility is the depth adjustment of the hinge arm, that is the adjustment of the distance of the cabinet door to the front side of the cabinet, which is made known by the document DE 29811 793 U1. Generally depth adjustment is achieved by a clamping screw by which the hinge arm is fastened on the mounting plate. The clamping screw projects through a slotted hole in the hinge arm; the depth adjustment takes place by sliding along the slotted hole and the depth-adjusting path is determined by the length of the slotted hole.

The known adjustment devices have, however, substantial disadvantages.

With reference to the lateral adjustments of the door, the hinge arm swings around an imaginary axis by turning the side adjustment screw, with the adjusting movement resulting along a circular arc. Thus, not only is the lateral position of the door adjusted, but, inadvertently, the depth position of the door is adjusted, so that the door's distance from the cabinet's front edge is changed.

The problem exists with the depth adjustment that the depth adjustment screw must be loosened in order to make sliding or shifting along the slotted hole possible. This means a delicate or sensitive adjustment is not possible with this method.

A hinge with a balance function with side adjustments is described in DE 29914 473 U1. At least one swing lever is provided that rotates when the side adjustment screw is swiveled and the hinge arm is supported directly or indirectly on it, so that the hinge arm, when the reveal adjustment screw is turned by at least one swing lever, is guided parallel to the baseplate. The design presented, however, appears to be very complex and costly in the production.

From the current state of technology, no suitable height or vertical adjustment of hinges, as well as cabinet doors to the cabinet body, is known.

The task of the present invention is based on a mounting plate for a cabinet/furniture hinge, which avoids the disadvantages given above and to develop a guided, easy and smooth running height adjustment of the hinge, as well as an adjustment of the cabinet door to the cabinet body.

SUMMARY OF THE INVENTION

This task is solved by the technical precepts of Patent claim 1.

The invention is based on the fact that the baseplate is designed in two parts, with an upper part and a lower part, and a height adjusting screw that is provided to secure and vertically adjust the upper part on the lower part, and has at least one eccentric or cam disk with an angle-dependent modifier of the radius, whose eccentric or cam disk works together with at least one corresponding sliding cam of the upper part.

To achieve a side or lateral adjustment, the height adjusting screw has at least one eccentric or cam disk, with which the height adjusting screw's turning activates a transverse shifting of the baseplate's upper part to the fixed lower part of the baseplate.

The advantage here is that no automatic adjusting of the hinge is possible since the cam disks of the invention-related clamping height adjusting screw, which clamps both components of the baseplate's upper and lower parts together, are self-locking. This height adjustment is simple and easy to activate, even with heavy cabinet door.

The height adjusting screw engages, in each case, a corresponding bore hole of the baseplate's upper and lower part, and lies with its lower eccentric or cam disks on the upper surface of the upper part of the baseplate; the screw foot prevents it from unintentionally falling out, which was preferably attached by means of a riveting process. Before the assembly the height adjusting screw is provided with a bolt on the screw head's opposite side, which has a smaller diameter than the bore holes of the upper and lower parts of the baseplate. After inserting this bolt on the height adjusting screw in both congruent bore holes of the upper and lower parts of the baseplate, the bolts are then riveted from below, thus, forming a type of rivet head.

In other embodiments of the invention, the height adjusting screw can also have a thread on its bolt-side end and be secured under the lower part of the baseplate with a, for example, self-locking nut.

There are also embodiments with securing rings, split pins or cotters, or with a lower spreading of the bolt-sided end of the height adjusting screw to secure to the underside of the baseplate's lower part.

The eccentric or cam disk works together with a gliding cam on the upper part of the baseplate on which the sliding cam is preferably located within the recess, in which the eccentric or cam disk, and also the head of the height adjusting screw, can be located for protection and to save space. The gliding cam includes a stop surface to restrict the turning angle of the height adjusting screw, whose turning angle is typically approximately 330°. Furthermore, the gliding cam has a radial gliding surface, close-set and directed to the gliding surfaces of the eccentric or cam disk. It is preferred that two such gliding cams are available, which are located somewhat mirror-symmetrical to the longitudinal middle axis of baseplate parts, are set approximately 180° to each other and are mirror-inverted. Here, naturally, the stop surfaces are also arranged inversely for the rotation angle restriction of the height adjusting screw; that is, the one to stop in the clockwise direction and the other for the counterclockwise direction.

This (These) cam (s), with the stop surfaces and gliding surfaces, working together with the stop surfaces and gliding surfaces of the eccentric and cam disk (s) are arranged along the mantle surface of the height adjusting screw and is, preferably, in the cross-section somewhat partially sickle-formed through the height adjusting screw. The first end of this cam sickle is, therefore, designed as harmoniously radially increasing, whereas, the second end of this cam sickle abruptly decreases from the maximum radius to a smaller radius, which, for example, is as large as the radius of the cam sickle's first end; that is, corresponding somewhat to the radius of the bolt-shaped part of the height adjusting screw. Therefore, the radius can accommodate larger sickle parts (for example, about 180°), which also make the other angle degrees conceivable and possible.

By providing several cams, these can then be located in different levels one on the other and set or staggered to each other or mirrored to each other to the cross-axis of the height adjusting screw. With, for example, two cams that each have 180°, they are preferably placed in two levels, and while the first cam has a stopping cam when the height adjusting screw turns left (counterclockwise), the other cam has a stopping cam, whereby the stop surfaces and gliding surfaces are always provided in the same angles area of the height adjusting screw.

The stop surface of the cam can decrease from the maximum radius deflection (steering lock) in the angle of 90° directly in the radial direction towards the standard width of the bolt part of the height adjusting screw, or else also in the angle (as, for example, in an obtuse or acute angle depending upon the function), so that with the obtuse angle the height adjusting screw is turned with increased force or with the acute angle, an almost play-free form closure with the corresponding counter-surface on the upper part of the baseplate becomes possible.

The height adjusting screw also has, preferably, two somewhat opposite, overlapping cam disks. Because the cam disks move in opposite directions, an approximate doubling of the regulating distance is achieved in contrast to the distance achieved by only one cam.

The upper part of the baseplate has a recess in which stop surfaces (stop and gliding surfaces) for both cam disks are formed in the shape of cams.

The invention, based on embodiment examples, is more closely described in the following with reference to several drawings. Further characteristics, features and advantages of the invention follow from the drawings and their descriptions.

DETAILED DESCRIPTION

Figure 1:
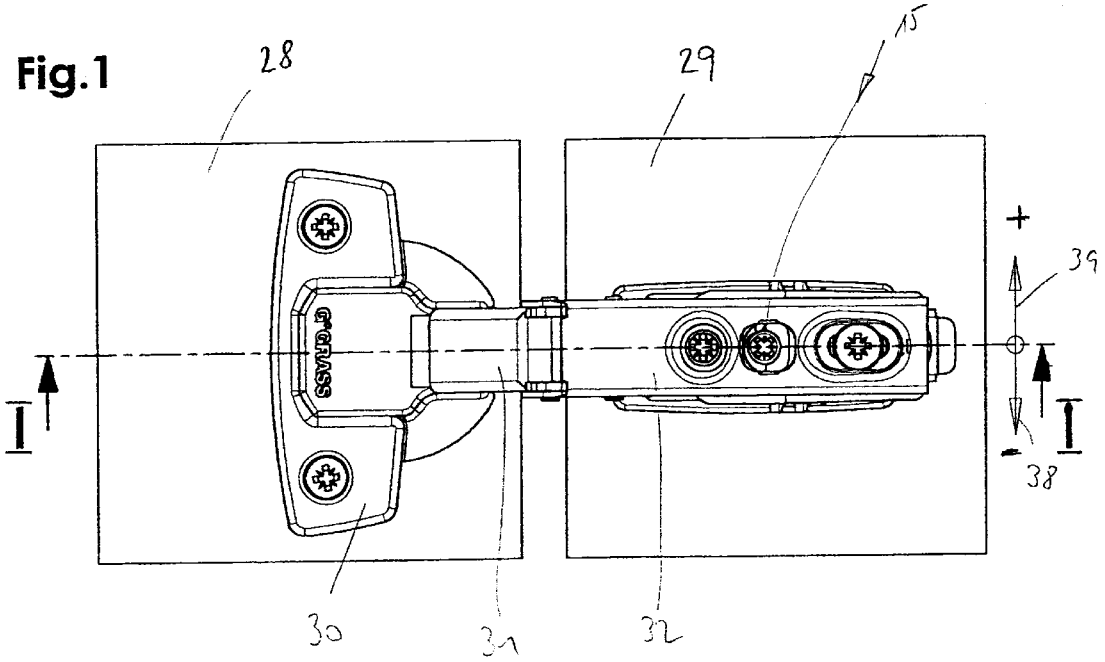
FIG. 1: an overview of the invention-related cabinet hinge in the assembled and mounted state.
Figure 2:
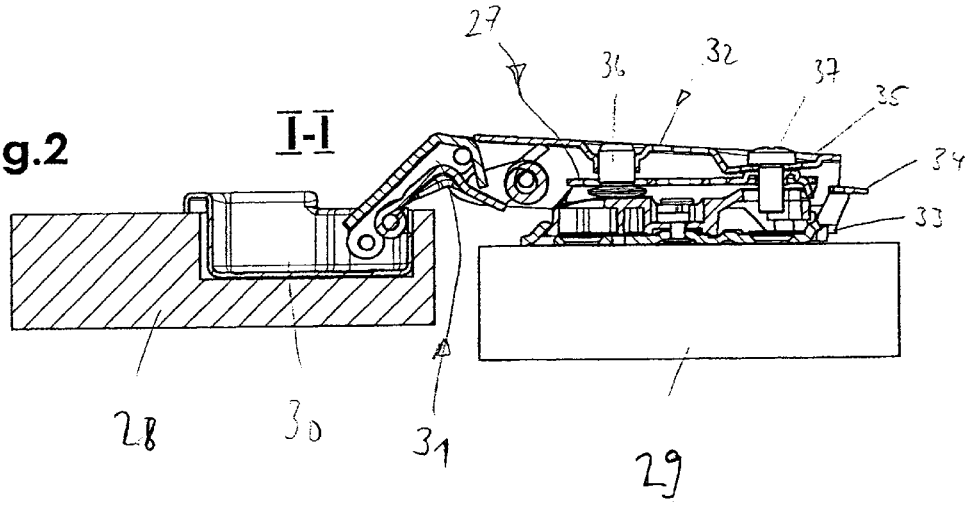
FIG. 2: a section through the bottom view of the invention-related cabinet hinge in the assembled and mounted state along Line 1—1 of FIG. 1.

FIG. 1 shows the overview of the invention-related cabinet hinge in the assembled and mounted state; FIG. 2 shows the bottom view to this in the longitudinal section. Both these FIGS. 1 and 2 simply serve to show the overview of the application location and construction method of the invention-related cabinet hinge.

A hinge cup (30) on a cabinet door (28) is fastened by means of a corresponding fastening screw inside a recess. This hinge cup (30) is connected by a conventional hinge (31) with a conventional hinge arm (32), which is connected by a horizontal adjusting screw (36) (side adjustment) and a fastening screw (37) with the adjusting plate (27). The adjusting plate (27) with a spring (33) and handle (34) again is clipped on the upper part (3) of the baseplate (10, as already shown in DE 19920 137 A1. The upper part (3) is now connected by the corresponding catch connection (FIG.

10) with the lower part (2) of the baseplate (1), whose lower part (2) is screwed onto the cabinet body (29).

The adjusting plate (27) consists of a essentially u-shaped bent, longish "oblong" one-piece part, made preferably from a metal component. A spring clip (33) is formed one-piece from the adjusting plate (27), whose shank engages somewhat in the middle area of the lengthwise sides of the adjusting plate and continues to the back over the end of the adjusting plate, where it is connected by a handle (34), which forms the back end of the spring clip (33), in order to be able to be activated manually.

The upper part (3) has on its back end, each on the left and right, catch steps (35), which serve to engage the rear section of the spring clip (33). These catch steps (33) provide a play balance and guarantee a clearance-free or almost clearance-free engagement of the springy clip (33) to the upper part (3).

Figure 10:
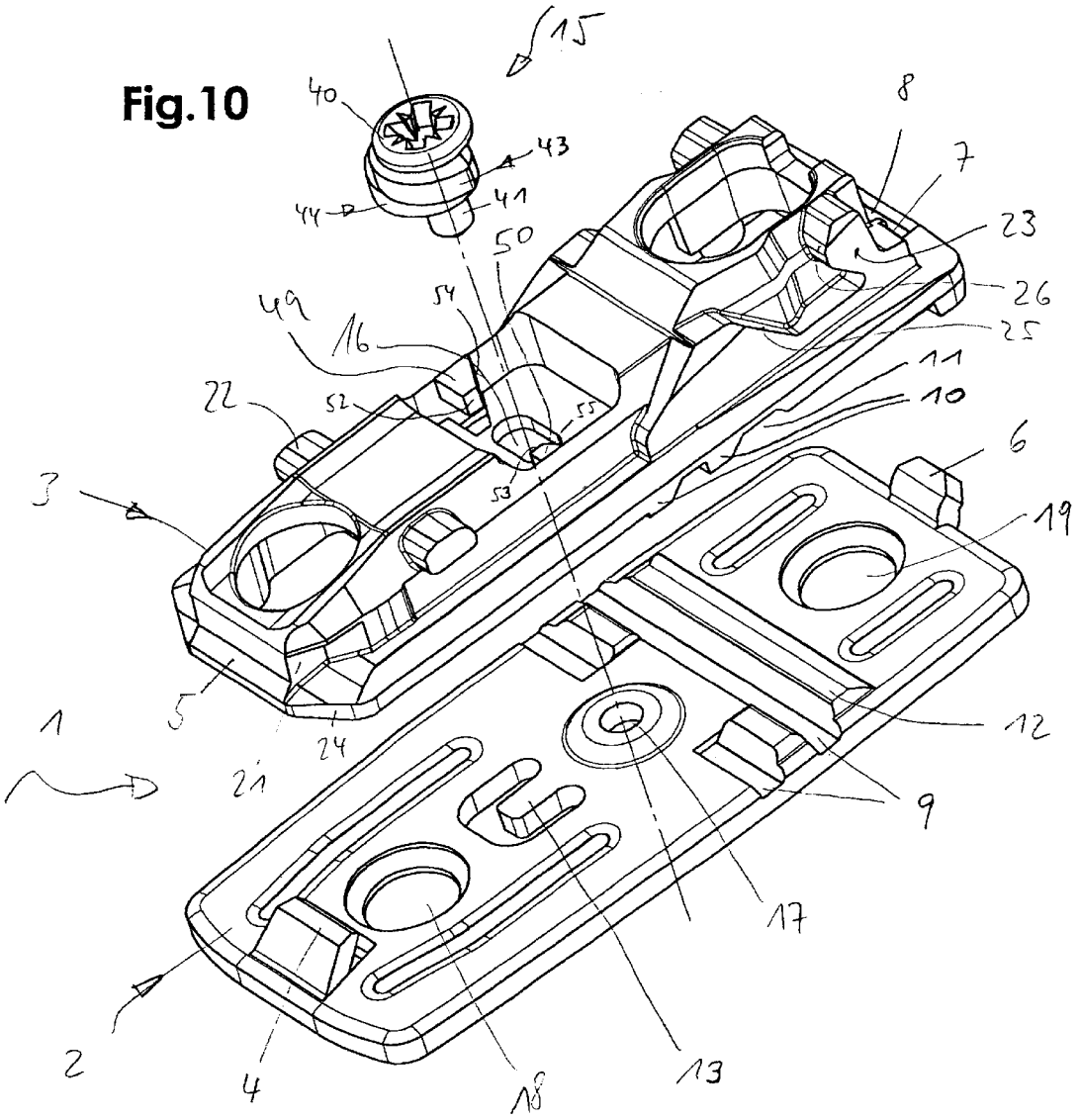
FIG. 10: an exploded representation of FIGS. 3, 4, 7 and 8.

FIG. 10, in the exploded representation, shows the design and structure of the baseplate (1) of the mounting plate, consisting of a lower part (2), with which the upper part (3) is connected. The lower part (2) has on its front end an approximately 45° upwards angled notch (4) and on the rear end a corresponding, approximately 45° downward angled post (6). The notch (4) and the post (6) are assigned corresponding slants (5, 8) of the upper part (3); whereby, the upper part (3) is installed into the lower part (2) so that the notch (4) and the post (6) fits on the corresponding slants (5, 8). The post (6) engages through an opening (7) of the upper part (3). There is at least one guiding groove (9) on the lower part (2), in which a corresponding guiding cam (10) engages with the inserted upper part (3), thus, securing the position between the assembly parts (2, 3) in the lengthwise direction. The example here shows an additional guiding groove (11) located on the upper part (3) that works together with a corresponding guiding cam (12) of the lower part (2).

The lower part, itself, is fastened by means of screws or something similar, which engage in the corresponding bore holes (18, 19).

Furthermore, there is a safety "anti-fall-out" device (13) located in the form of a tab on the lower part, which, after the mounting of the upper part (3) on the lower part (2), is pressed upward and fits itself on a corresponding surface (14) of the upper part, so that a shifting between the lower part (2) and the upper Part (3) is no longer possible. This safety "anti-fall-out" device (13, 14) serves to secure the connection between the lower part (2) and the upper part (3), even if the provided height adjusting screw (15), which engages through an opening (16) of the upper part (3) in a corresponding bore hole (17) of the lower part (2) and is riveted there, is defective. The upper part (3) can be moved by the height adjusting screw (15) in a lateral direction on the lower part (2) and the position can be secured by the self-locking of the eccentric and cam disks of the height adjusting screw (15).

Furthermore, there are still other installation "hanging-in" methods to fasten the adjusting plate (27) on the baseplate (1), as well as the upper part (3) of the baseplate (1). Additionally, the upper part (3) has side recesses (21) in the front area, which is shown in connection to FIG. 5, which serve to hang in the corresponding installation "hang-in" cams (28). The "hang-in" installation cams (28) are made from the material of the adjusting plate (27).

FIG. 10, therefore, shows an exploded representation of the mounting plate's individual parts, consisting of a baseplate (1), which consists of a lower part (2) and an upper part (3), the height adjusting screw (15) to secure the side or lateral position of the connection between the lower part (2) and the upper part (3), as well as the adjusting plate (27) that is not shown here, that are installed ("hanged in") and engaged on the upper part (3) of the baseplate (1).

Figure 9:
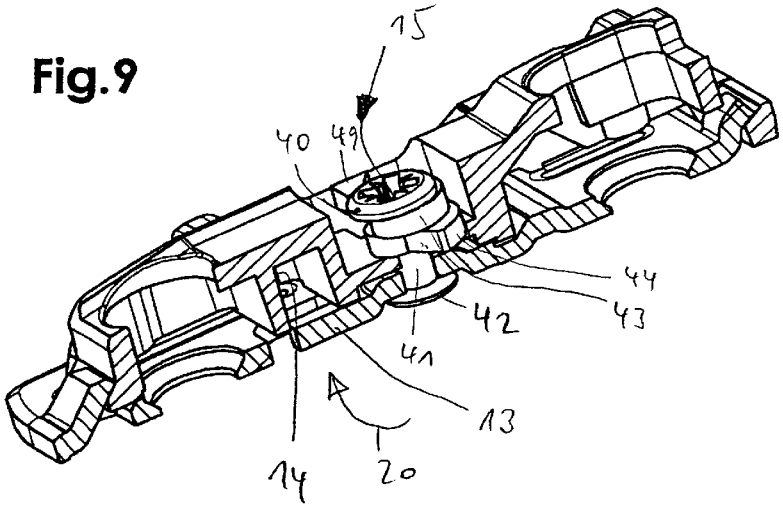
FIG. 9: a perspective view of a section along the longitudinal axis of FIGS. 3, 4, 7 and 8 with a height adjusting screw that is not cut.

FIG. 9, as well as FIG. 10, shows the structure of the baseplate (1) of the mounting plate, consisting of a lower part (2) that is connected to an upper part (3), however, in the lengthwise and assembled state. One recognizes the safety "anti-fall-out" device (13), that, after the upper part (3) is mounted on the lower part (2), is bent upward in arrow direction (20), so that the tabs (13) fit on the corresponding surface (14) of the upper part.

Figure 3:
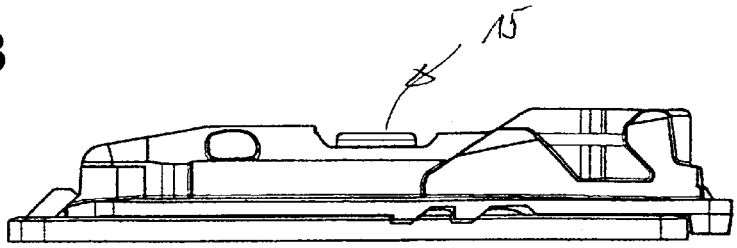
FIG. 3: the bottom view of the invention-related adjusting screw's assembled parts adjusting plate, as well as the baseplate with the upper and lower part.

FIG. 3 shows, in accordance with FIG. 9, likewise, the design and structure of the baseplate (1) of the mounting plate, but, however, not the cut bottom view.

Figure 4:
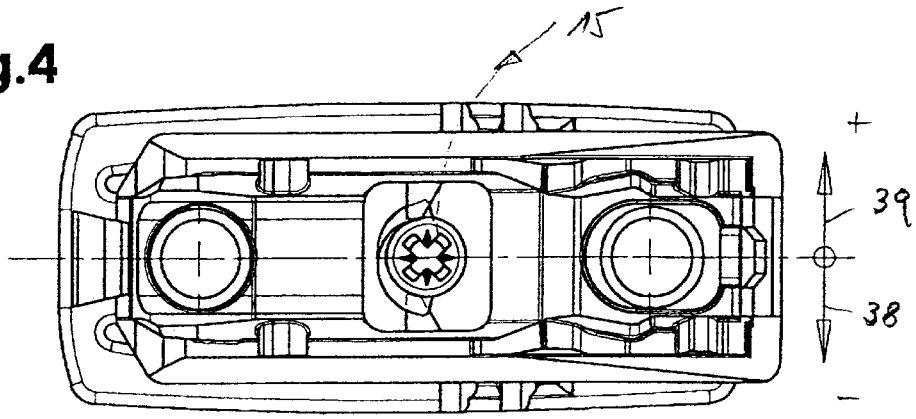
FIG. 4: the overview, according to FIG. 3.
Figure 7:
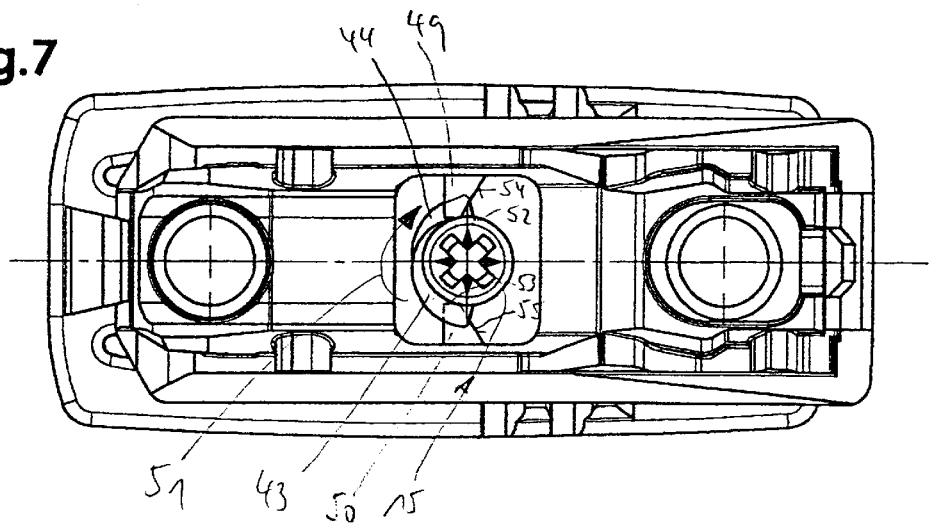
FIG. 7: an enlarged representation of the overview, according to FIG. 4, with the height adjusting screw in the center position.
Figure 8:
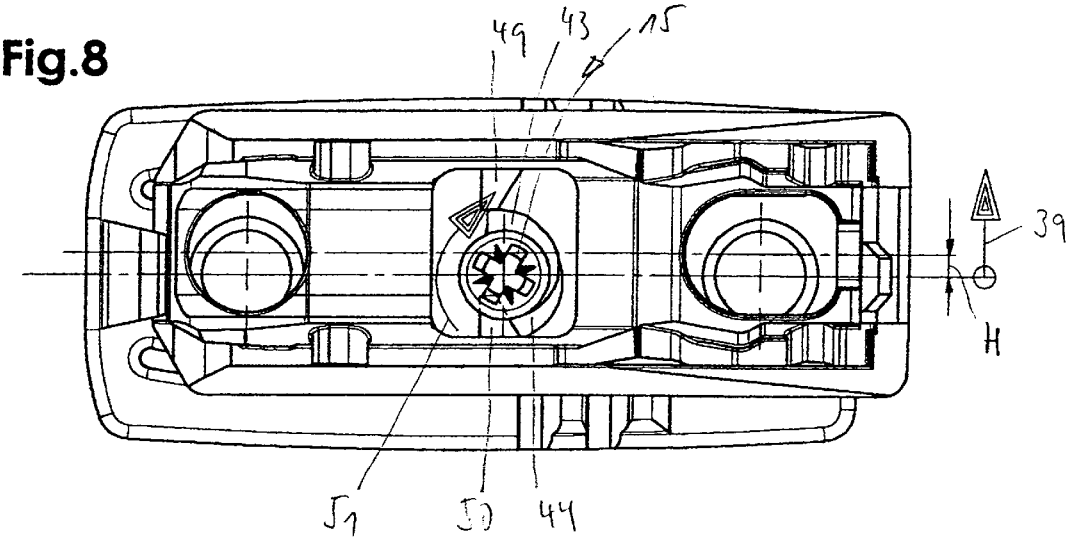
FIG. 8: an overview, according to FIG. 7, with the height adjusting screw in the upper maximum position.

FIGS. 4, 7 and 8 show an overview of the assembled baseplate (1) in which the representation of FIGS. 4 and 7 are identical, but FIG. 7 represents an enlargement and shows the upper part (3) to the lower part (2) in a middle position. both longitudinal axles of the upper part (3) and the lower part (2) overlap also in the overview. This is managed by vertical adjusting movements (38, 39) by means of the height adjusting screw (15).

On the other hand, FIG. 8 shows that turning the height adjusting screw (15) clockwise (51) towards the right, a height difference H is achieved upwards by a vertical adjusting movement (39), so that an upper part (3) is moved upward around the amount H to the lower part (2) of the baseplate (1). This corresponds to a lifting of the door around this amount H, which typically lies at approximately +/−1.5 mm.

FIG. 7 shows the middle position between the upper and lower part of the baseplate (1), what can be achieved by operating the height adjusting screw (15) in the turning direction (15) and, in addition, the contrary. In the middle position the cams (49, 50) lie with their gliding surfaces (52, 53) in the initial area of the corresponding gliding surfaces (45, 46). By continuing to turn the height adjusting screw (15) in the turning direction (51) in the clockwise direction up to the stop, then, according to FIG. 8, the lower stop surface (48) of the lower cam disk (44) comes to a stop with the corresponding stop surface (55) of the lower cam (50). The upper cam disk (43) is not situated relative to the upper cam (49) so that the gliding surface (52) of the upper cam (49) comes to lie in the area of the end of the gliding surface (45) of the upper cam disk (43), also in the area of the stop surface (47) of the upper cam disk (43).

The reverse is that turning the height adjusting screw (15) opposite the turning direction (51), that is counterclockwise, to the stop, the upper stop surface (47) of the upper cam disk (43) impacts with the corresponding stop surface (54) of the upper cam (49). The lower cam disk (44) would now be in a position relative to the lower cam (50), so that the gliding surface (53) of the lower cam (50) comes to be situated in the area of the end of the gliding surface (46) of the lower cam disk (44), thus, also in the area of the stop surface (48) of the lower cam disk (44).

Figure 5:
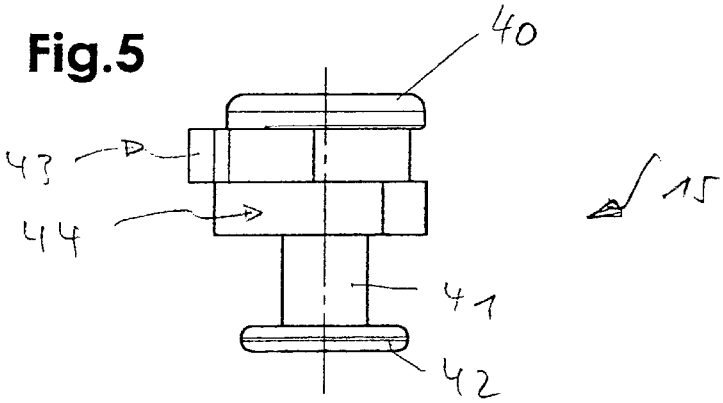
FIG. 5: the invention-related height adjusting screw in a radial direction.
Figure 6:
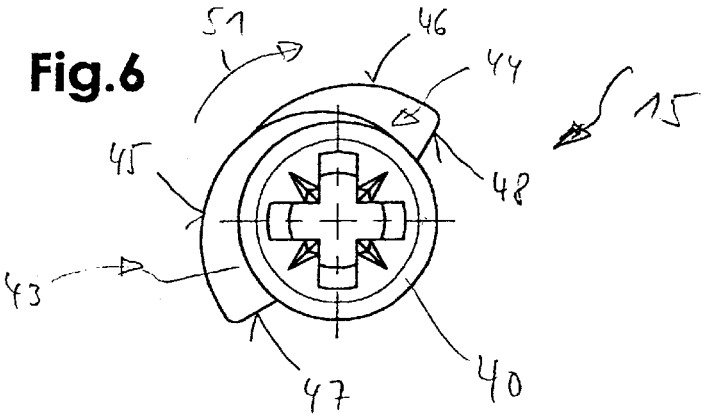
FIG. 6: the invention-related height adjusting screw, according to FIG. 5, in an axial direction.
Figure 11:
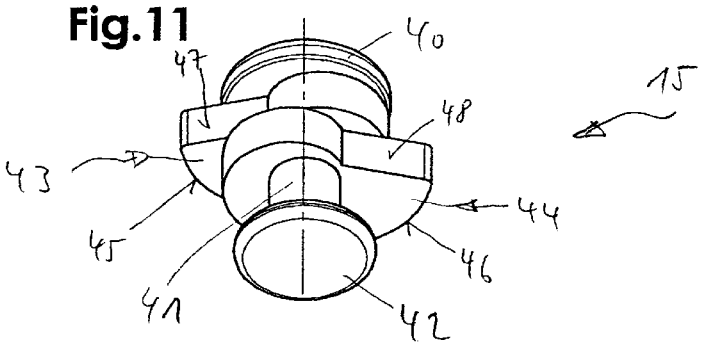
FIG. 11: an invention-related height adjusting screw in perspective representation.

FIGS. 5, 6 and 11 now show the invention-related height adjusting screw (15) in a riveted and spread-out or expanded state; whereas, FIG. 5 represents a radial view, FIG. 6 represents an axial view and FIG. 11 represents a perspective view from the foot.

The somewhat pin-shaped designed height adjusting screw (15) has an upper screw head (40) on which two cam disks (43, 44) a bolt-shaped part (41) and the riveted screw foot (42) connects downward. In the pre-mounted original state the height-adjusting screw (15) looks like the representation in FIG. 10; namely, without a screw foot (42), which is first, after the attachment of the bolt-formed part (41), by the overlapping bore holes (16, 17) of the upper and lower parts of the baseplate (1), riveted from below and, thus, in accordance with FIGS. 5, 6, 9 and 11, receives its foot shape.

The cam disk (43, 44) are, as is evident in FIG. 5, arranged in both the same quadrants of the height-adjusting screw (15), that is, in the same semi-circle; however, they move opposite to each other. Also in FIG. 5, if the height adjusting screw (15) is turned towards the right in turning direction (51), then the upper cam disk (43) runs with its upper gliding surface (45) on the gliding surface (52) of the corresponding cam (49) of the upper part (3); whereas, at the same time, the lower cam disk (44) with its lower gliding surface (46) runs on the gliding surface (53) of the corresponding cam (50) of the upper part (3). With the maximum possible rotation in the turning direction (51) to the right, the height adjusting screw (15) then impacts on stops with its lower stop surface (48) of the lower cam disk (44) on the corresponding stop surface (55) of the lower cam (50). Similarly, the height adjusting screw (15) with its upper stop surface (47) impacts the upper cam disk (43) on the corresponding stop surface (54) of the upper cam (49), if the height adjusting screw (15) were turned maximally against the turning direction (51).

| Drawing Legend |
|---|
| 1. Baseplate |
| 2. Lower part |
| 3. Upper part |
| 4. Notch |
| 5. Slant |
| 6. Post |
| 7. Opening |
| 8. Slant |
| 9. Guiding groove |
| 10. Guiding cam |
| 11. Guiding groove |
| 12. Guiding cam |
| 13. "Anti-fall-out" device |
| 14. Surface |
| 15. Height adjusting screw |
| 16. Bore hole |
| 17. Bore hole |
| 18. Bore hole |
| 19. Bore hole |
| 20. Arrow direction |
| 21. Recess |
| 22. Cam |
| 23. Shank |
| 24. Shoulder |
| 25. Gliding surface |
| 26. Gliding surface |
| 27. Adjusting plate |
| 28. Cabinet door |
| 29. Cabinet body |
| 30. Hinge cup |
| 31. Hinge |
| 32. Hinge arm |
| 33. Spring clip |
| 34. Handle |
| 35. Catch steps |
| 36. Horizontal adjusting screw |
| 37. Fastening screw for 32 |
| 38. Vertical downward adjustment movement |
| 39. Vertical upward adjustment movement |
| 40. Screw head with recess for tool |
| 41. Bolt |
| 42. Bolt foot |
| 43. Upper cam disk |
| 44. Lower cam disk |

-continued

| Drawing Legend |
|---|
| 45. Upper radial self-adjusting gliding surface |
| 46. Lower radial self-adjusting gliding surface |
| 47. Upper turning periphery surface |
| 48. Lower turning periphery surface |
| 49. Upper gliding cam of 3 |
| 50. Lower gliding cam of 3 |
| 51. Turning direction |
| 52. Gliding surface of 49 |
| 53. Gliding surface of 50 |
| 54. Stop surface of 49 |
| 55. Stop surface of 50 |

What is claimed is:

1. A hinge, comprising a baseplate comprising a lower part that can be fastened to the cabinet body and an upper part that can be tensed to the lower part, the hinge further comprising a height adjusting screw comprising at least one eccentric or cam disk with an angle-dependent, gliding surface that works together with at least one gliding surface of a corresponding gliding cam of the upper part, wherein said at least one eccentric or cam disk extends from the height adjusting screw from a minimum radial distance to a maximum radial distance along an angle area of about 180°, and wherein said adjusting screw provides for the fixing and height adjustment of the upper part relative to the lower part.

2. The hinge according to claim 1, wherein the height adjusting screw comprises a screw head with a recess for holding tools.

3. The hinge according to claim 1, wherein the height adjusting screw comprises a bolt-shaped part on the opposite end from the screw head.

4. The hinge according to claim 1, wherein the radius of the gliding surface of the eccentric or cam disk continually increases or decreases along the periphery of the height adjusting screw by an angle area of about 180°.

5. The hinge according to claim 1, wherein the radius of the gliding surface of the eccentric or cam disk extends from the outer diameter of the bolt-shape part from between 0 and about the amount of the bolt-shaped part's radius.

6. The hinge according to claim 1, wherein the lower part comprises a notch on a front end and a post on a back end, which fit corresponding slants of the upper part to securedly engage the upper and lower parts.

7. The hinge according to claim 1, wherein at least one of the lower part or, upper part comprises at least one guiding groove that works together with a corresponding guiding cam of the alternate part thus securing the position between the upper part and lower part in the lengthwise direction.

8. The hinge according to claim 1, further comprising a tab on the lower part, that fits on a corresponding surface of the upper part, to prevent the pieces from disengaging.

9. The hinge according to claim 1, further comprising a spring clip formed one-piece out of the adjusting plate so that it projects backwards as a springy, frame-type edge of the adjusting plate in order to be activated manually.

10. The hinge, according to claim 1, wherein the height adjustment screw extends through a corresponding aperture on the upper part and lower part of the mounting plate, and is securedly held by a screw foot.

11. The hinge according to claim 10, wherein the screw foot is made by a threading the bolt-shaped part.

12. The hinge according to claim 1, wherein the at least one eccentric or cam disk further comprises one stop surface, which corresponds with at least one stop surface on the corresponding gliding cam of the upper part.

13. The hinge according to claim 12, wherein the stop surfaces run somewhat radial to the longitudinal axis of the height adjusting screw.

14. The hinge according to claim 12, wherein the stop surfaces are provided in the maximum radius area of the gliding surfaces of the eccentric or cam disk.

15. The hinge according to claim 1, wherein the height adjusting screw further comprises a plurality of eccentric or cam disks that have gliding surfaces.

16. The hinge according to claim 15, wherein the eccentric or cam disks are placed axially lying one on top of the other.

17. The hinge according to claim 15, comprising two eccentric or cam disks that have opposite gliding surfaces that lie one on top of the other.

18. The hinge according to claim 17, wherein both opposite gliding surfaces are placed somewhat inside the same 180° angle of the height adjusting screw.

19. The hinge according to claim 15, wherein the plurality of eccentric or cam disks have stop surfaces.

20. The hinge according to claim 1, further comprising an adjusting plate, comprising installation cams, engaged to the upper part of the base plate, wherein a side recess located on the front end of the upper part engages the corresponding installation cams of the adjusting plate.

21. The hinge according to claim 20, wherein side cams located on the front end of the upper part engage corresponding installation shanks of the adjusting plate.

22. The hinge according to claim 21, further comprising installation shanks located on the back end of the upper part engage corresponding installation shanks of the adjusting plate.

* * * * *

UNITED STATES PATENT AND TRADEMARK OFFICE

CERTIFICATE OF CORRECTION

PATENT NO. : 6,698,062 B2 
DATED : March 2, 2004
INVENTOR(S) : Remo Egger and Wolfgang Mueller It is certified that error appears in the above-identified patent and that said Letters Patent is hereby corrected as shown below:

Title page,
Insert Item

-- [30] Foreign Application Priority Data

March 3, 2001 DE 101 10 311.5 --

Column 8,
Line 63, "foot is made by a threading the bolt-shaped part." should read -- foot is made by threading the bolt-shaped part. --
Line 65, "one eccentric or cam disk further comprises one stop" should read -- one eccentric or cam disk further comprises at least one stop --.

Signed and Sealed this

Twenty-second Day of June, 2004

JON W. DUDAS
*Acting Director of the United States Patent and Trademark Office*